US006311694B1

(12) United States Patent
Nichols et al.

(10) Patent No.: US 6,311,694 B1
(45) Date of Patent: Nov. 6, 2001

(54) SMOKING ARTICLE HAVING REDUCED SIDESTREAM SMOKE

(75) Inventors: Walter A. Nichols, Chesterfield; John R. Hearn, Midlothian; F. Murphy Sprinkel, Jr., Glen Allen; Jay A. Fournier, Richmond; Jerry F. Whidby, Urbanna, all of VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/347,027

(22) Filed: Jul. 2, 1999

(51) Int. Cl.[7] ..... A24F 13/02; A24F 1/28; A24D 1/12; A24D 1/10

(52) U.S. Cl. ..... 131/187; 131/175; 131/174; 131/191; 131/198.1; 131/349; 131/360

(58) Field of Search ..... 131/175, 329, 131/330, 187, 191, 194, 174, 190, 198.1, 349, 256, 360

(56) References Cited

U.S. PATENT DOCUMENTS

| | | | | |
|---|---|---|---|---|
| 1,522,108 | * | 1/1925 | Digney | 131/175 |
| 4,386,616 | * | 6/1983 | Rosen | 131/174 |
| 5,152,304 | | 10/1992 | Bokelman et al. | 131/365 |
| 5,592,955 | | 1/1997 | Keritsis | 131/175 |

FOREIGN PATENT DOCUMENTS

| | | | | |
|---|---|---|---|---|
| GB 100326 | * | 5/1916 | (GB) | 131/175 |
| GB 120185 | * | 10/1918 | (GB) | 131/175 |

OTHER PUBLICATIONS

Colin L. Browne's "The Design of Cigarettes", Hoechst Celanese Corporation, copyright 1990.

* cited by examiner

*Primary Examiner*—James Derrington
*Assistant Examiner*—Dionne A. Walls
(74) *Attorney, Agent, or Firm*—Burns, Doane, Swecker & Mathis, LLP

(57) ABSTRACT

A smoking article comprises a smoking accessory and a cigarette. The smoking accessory includes a holder and a substantially air-impermeable sleeve which is coupled to a distal portion of the holder and is coaxial therewith. The cigarette is received in the smoking accessory such that a distal end of the cigarette is located substantially flush with a distal end of the sleeve. The cigarette includes a column of tobacco which is shorter than that used in conventional cigarettes, e.g., 20 mm in length or less. An air gap separates an outer surface of the cigarette from the sleeve, and plural openings are formed in the sleeve to supply air to the cigarette. In use, the sleeve restricts the flow of air to the cigarette, thereby slowing combustion and reducing side-stream smoke between puffs.

19 Claims, 2 Drawing Sheets

SMOKING ARTICLE HAVING REDUCED SIDESTREAM SMOKE

FIELD OF THE INVENTION

The present invention relates to a smoking article having reduced sidestream smoke, and, in particular, to a smoking article comprising a combination of a smoking accessory and a cigarette.

BACKGROUND OF THE INVENTION

Conventional cigarettes include a column of smokable material, usually shredded tobacco material, wrapped in a combustible, air permeable paper wrapper. A filter, such as an acetate tow filter, is often wrapped in a substantially air-impermeable plug wrap paper, and is attached to an end of the wrapped tobacco column by tipping paper. As stated in Colin L. Browne's "The Design of Cigarettes," Hoechst Celanese Corporation, copyright 1990, the typical blended cigarette in the United States is either 85 mm or 100 mm in length with a diameter of about 8 mm. These cigarettes typically include a tobacco column of about 60 mm to 65 mm in length.

A typical cigarette contains 750 mg to 800 mg of tobacco. Approximately 20 mg of this tobacco is burned during a puff, while approximately 50 mg is consumed between puffs. The smoke generated by the burning tobacco during a puff is termed "mainstream smoke," while the smoke generated between puffs is termed "sidestream smoke." Since a large portion of the tobacco is wasted during quiescent periods between puffs, some manufacturers have attempted to reduce the combustion of tobacco during these quiescent periods.

One technique for reducing the sidestream smoke of cigarettes involves adding a burn modifier to the cigarette wrapper paper. Various compounds may be added to the cigarette wrapper paper to affect the sidestream smoke level. Commonly assigned U.S. Pat. No. 5,152,304, for example, indicates that the use of an acidic salt added to the cigarette wrapper paper reduces sidestream smoke.

Another technique for reducing sidestream smoke generally involves restricting the supply of oxygen to the tobacco column. For instance, commonly assigned U.S. Pat. No. 5,592,955 discloses disposing a tobacco column in a reusable, non-combustible, air-permeable shell. A filter is attached to one end of the shell by inserting the shell into a shell wrapper that is preattached to the filter by tipping paper. The shell reduces combustion between puffs, thereby reducing sidestream smoke, yet permits sufficient air flow to the lit tobacco column to avoid extinguishing the column. Commonly assigned U.S. application Ser. No. 09/003,497, filed on Jan. 6, 1998, discloses disposing a tobacco column in a laminated wrapper comprising a layer of aluminum foil sandwiched between two layers of paper. The wrapper restricts the flow of air to the tobacco column. A carbon ignition element is disposed within the tobacco column. The ignition element, in conjunction with perforations formed in the laminated wrapper, prevent the cigarette from extinguishing between normal puffs.

While several different techniques for reducing sidestream smoke have been proposed, there exists a need for additional effective techniques for reducing sidestream smoke.

SUMMARY OF THE INVENTION

One exemplary embodiment of the present invention comprises a smoking article which includes a smoking accessory and a cigarette. The smoking accessory includes a holder and a substantially air-impermeable sleeve which is coupled to a distal portion of the holder and is coaxial therewith. The cigarette is received in the smoking accessory such that a distal end of the cigarette is substantially flush with a distal end of the sleeve. The cigarette includes a column of tobacco which is shorter than that typically used in conventional cigarettes. A gap separates an outer surface of the cigarette from the sleeve, and plural openings are formed in the sleeve to supply supplemental airflow to the cigarette.

In use, the sleeve restricts the airflow to the cigarette, thereby slowing combustion and reducing sidestream smoke between puffs. However, the air gap and the openings in the sleeve permit a sufficient supply of air to the cigarette to prevent it from extinguishing between normal puffs.

BRIEF DESCRIPTION OF THE DRAWINGS

The foregoing, and other, objects, features and advantages of the present invention will be more readily understood upon reading the following detailed description in conjunction with the drawings in which.

DETAILED DESCRIPTION OF THE PREFERRED EMBODIMENTS

In the following description, for purposes of explanation and not limitation, specific details are set forth in order to provide a thorough understanding of the invention. However, it will be apparent to one skilled in the art that the present invention can be practiced in other embodiments that depart from these specific details. In other instances, detailed descriptions of well-known methods and devices are omitted so as not to obscure the description of the present invention with unnecessary detail. In the figures, like numbers designate like elements.

Figure 1:
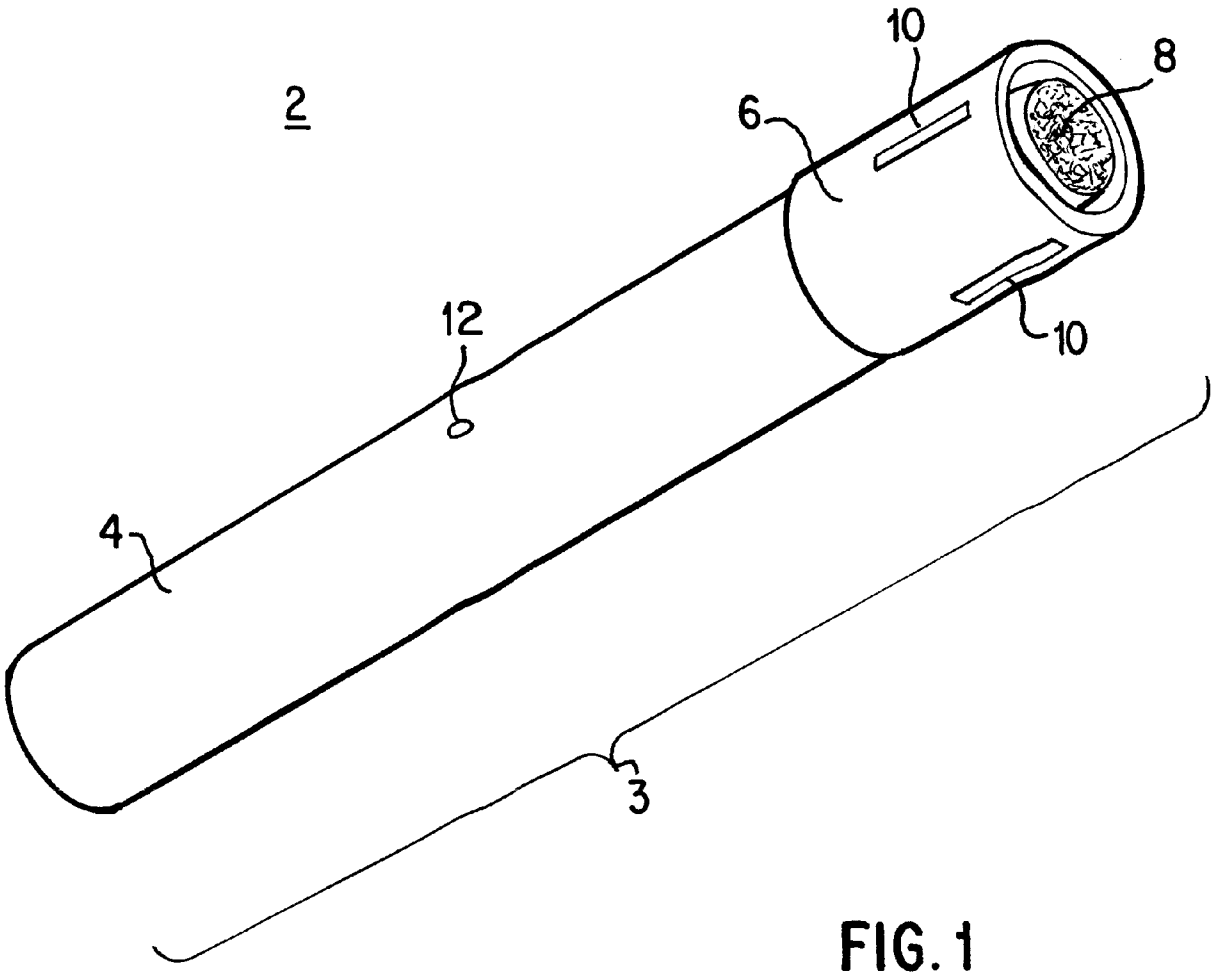
FIG. 1 shows a perspective view of a smoking article according to one embodiment of the present invention.

FIG. 1 shows a smoking article 2 according to one exemplary embodiment of the present invention. The smoking article 2 comprises a smoking accessory 3 and a cigarette 8. The smoking accessory 3 is basically a tube having an internal longitudinal passageway which receives the cigarette 8. More specifically, the cigarette 8 is received in the passageway such that the distal end of the cigarette 8 is substantially flush with the distal end of the smoking accessory 3. (In the following discussion, "distal" generally refers to the part of a component closest to the coal of the smoking article when initially lit, while "proximal" refers to the part of the component opposite to the distal part.)

Figure 2:
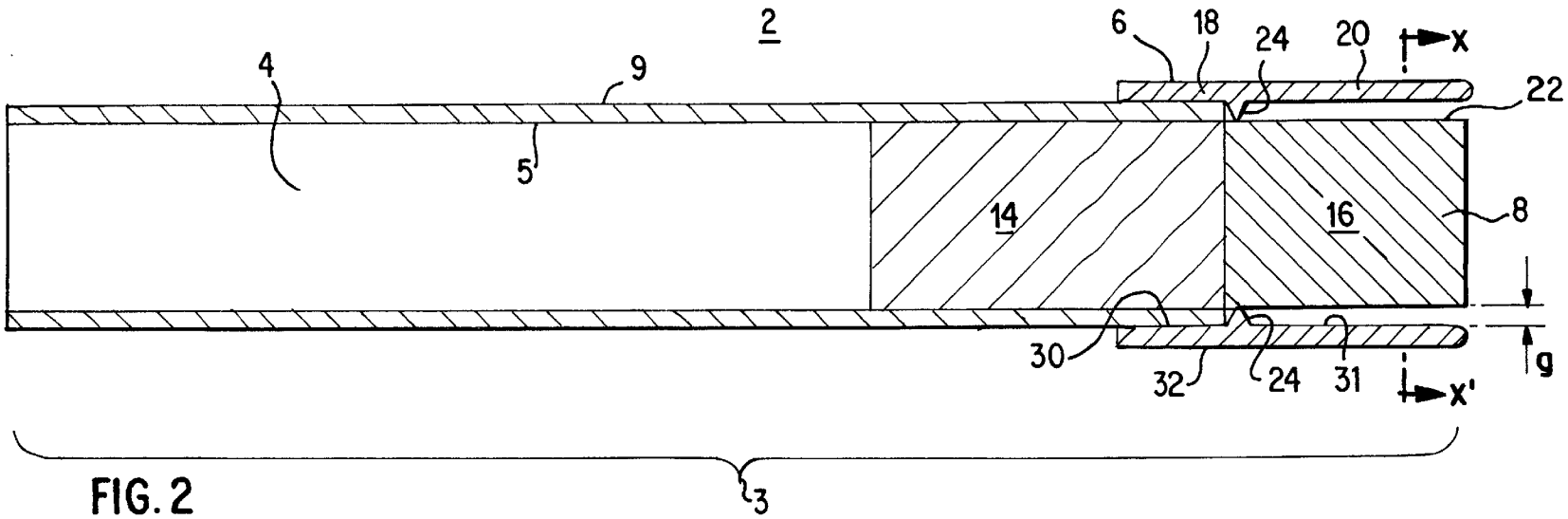
FIG. 2 shows a cross section of the smoking article shown in FIG. 1 along the longitudinal axis of the smoking article.

FIG. 2 shows the construction of the smoking accessory 3 in greater detail. The smoking accessory 3 includes holder 4 and a sleeve 6. The holder 4 comprises a cylindrical tube having an inner surface 5 and outer surface 9. The sleeve 6 also comprises a cylindrical tube and includes a first section 18 and a second section 20 separated by a stopper element 24. Sleeve sections 18 and 20 have inner surfaces 30 and 31, respectively, and common outer surface 32. The stopper element 24 may comprise a ring-like ridge which extends radially inward toward the center axis of the sleeve 6, or may comprise one or more separate elements which extend radially inward toward the center axis of the sleeve 6.

FIG. 2 also illustrates how the holder 4 is attached to the sleeve 6, by friction fit, for instance. The outer diameter of the holder 4 (i.e., the diameter defined by the outer surface 9 of the holder 4) can be slightly smaller than the inner diameter of the sleeve section 18 (i.e., the diameter defined by the inner surface 30 of sleeve section 18). Accordingly, the sleeve 6 can be slid over the distal end of the holder 4 until the distal end of the holder 4 contacts the stopping element 24.

The holder 4 and sleeve 6 can be held together by expedients other than friction fit. For instance, the holder 4 and sleeve 6 can be glued together or joined by a screw-type coupling mechanism or a snap-fit coupling mechanism.

The inner surface 31 of sleeve section 20 defines an opening having a first diameter, while the inner surface 30 of sleeve section 18 defines an opening having a second diameter. In the illustrated embodiments, the first diameter is the same as the second diameter. In other embodiments (not shown), the first diameter can be larger than the second diameter, or vice versa. In any event, it is preferred that a continuous or non-continuous air gap "g" be provided between the interior surface 31 of the sleeve section 20 and the outer surface 22 of the cigarette 8. The size of the gap can be the same over the longitudinal extent of the sleeve section 20. Alternatively, the size of the gap can vary over the longitudinal extent of the sleeve section 20.

In the illustrated embodiment, the cigarette 8 is held in the smoking accessory 3 by friction fit engagement with the distal portion of the holder 4 and possibly with the stopper element 24 (depending on how far the stopper element 24 radially extends into the smoking accessory 3). The cigarette 8 can also be anchored in the smoking accessory 3 by additional protrusions (not shown) which radially extend from the inner surface 31 of sleeve section 20 into the smoking accessory 3. These additional protrusions may be useful to maintain the gap between the sleeve 6 and the tobacco column 16, especially in those cases where the sleeve is constructed of foil (or other thin and/or easily deformable material). The gap can also be maintained by constructing the cigarette 8 such that it has protrusions on its outer surface 22. For instance, grooves can be provided on the outer surface 22 of the cigarette 8 by crimping the outer surface 22 of the cigarette using a forming tool.

Although not shown, a perforated cap can be added to the distal portion of sleeve 6. This cap can be formed integrally with the sleeve 6, or can be detachable from the sleeve 6. Closing off the end of the sleeve 6 may be advantageous to contain the ashes which are produced during the smoking of the cigarette 8.

The dimensions of the holder 4 and sleeve 6 can be varied to accommodate different cigarettes. In one exemplary and non-limiting embodiment, the length of the smoking assembly 3 is approximately 85 mm, the length of the holder 4 is approximately 70 mm, and the length of the sleeve is approximately 20 mm. The diameter defined by the outer surface 9 of the holder 4 is approximately 9 mm and the diameter defined by the outer surface 32 of the sleeve 6 is approximately 10 mm. The thickness of the cylindrical wall of holder 4 is approximately 1 mm and the thickness of the cylindrical wall of sleeve 6 is approximately 0.5 mm. In one exemplary embodiment, the gap between the sleeve 6 and the surface 22 of the cigarette 8 is approximately 0.5 mm. The foregoing dimensions are exemplary and it will be apparent to those skilled in the art that such dimensions can be varied as may be desired. For instance, the length of the holder 4 can be shortened so that the proximal end of the cigarette 8 protrudes beyond the proximal end of the smoking accessory 3.

While the sleeve 6 can reach temperatures up to 300° C., the holder 4 is preferably constructed of materials which ensure that the temperature of the assembly during use does not become too hot to the touch (e.g., no greater than about 60° C.). Suitable materials for the holder 4 include, for example, ceramics, composites, polymers or paper-based materials (e.g., cardboard). Suitable materials for the sleeve include, for example, ceramics or metals. The holder 4 and sleeve 6 can also be constructed from multiple materials. For instance, the holder 4 and/or the sleeve 6 can be constructed from multilayered materials, i.e., a layer of metal or ceramic laminated to a layer of cardboard. Other combinations of material layers are possible.

Figure 3:
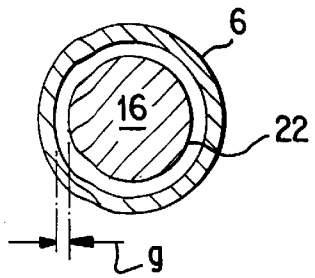
FIG. 3 shows a cross section of the smoking article along line X–X' shown in FIG. 2.

FIGS. 1–3 pertain to an embodiment in which the smoking accessory 3 (comprising holder 4 and sleeve 6) is reusable. Accordingly, the holder 4 and sleeve 6 are preferably formed of materials which can withstand repeated use. A ceramic holder (e.g., zirconia or alumina) and a stainless steel or aluminum sleeve may be suitable for this application. Alternatively, the present invention can be implemented as a disposable smoking article 2. In this case, a cardboard holder and metal foil sleeve may be more suitable for economic reasons.

Various openings in the smoking accessory 3 contribute to airflow through the smoking article 2 during use. For instance, referring to FIG. 1, the sleeve 6 includes plural slots 10 in its wall. These slots 10 help sustain the combustion of the cigarette by providing sufficient levels of oxygen to the tobacco column inside the sleeve 6. In one embodiment, four slots 10 can be used having a length of about 10 mm and a width of approximately 0.5 mm. The slots 10 can be located approximately 1 mm from the distal end of the sleeve 6 and are spaced at equal intervals around the circumference of the sleeve 6. The number, size and placement of the slots 10 (or other shaped perforations) are exemplary. Different numbers, sizes, shapes and/or placements of perforations may be appropriate for cigarettes having different characteristics. Characteristics which may have a bearing on the number, size, shape and/or placement of the perforations include wrapper permeability, tobacco column density, wrapper composition, etc. Finally, an optional dilution hole 12 can be provided in the wall of the holder 4. This hole 12 can dilute the smoke drawn through the smoking accessory 3 to a desired level. For instance, the hole 12 can dilute the smoke by approximately 20%. Additional dilution holes can be used, or the dilution hole 12 can be eliminated altogether. Again, this is dependent, in part, on the type of cigarette used and/or the preferences of the user.

Figure 4:
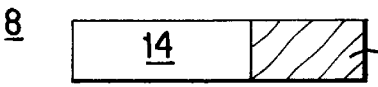
FIG. 4 shows the cigarette used in the embodiment of FIGS. 1 through 3.

The cigarette 8 itself comprises, in one embodiment, a tobacco column 16 joined to a filter 14, as illustrated in FIGS. 2 and 4. A conventional acetate filter can be used. Although not shown, the tobacco column 16 and filter 14 are wrapped in one or more layers of cigarette, plug wrap and/or tipping paper, as is well known in the art (note for instance, the discussion in Colin L. Browne's "The Design of Cigarettes," Hoechst Celanese Corporation, copyright 1990, which is incorporated herein in its entirety by reference). However, whereas conventional cigarettes commonly have a tobacco column length of about, e.g., 60 mm, the cigarette 8 has a tobacco length of about 10 mm to 30 mm, e.g., about 17 mm. This results in a cigarette 8 which is shorter than conventional cigarettes. In the case where cigarette 8 has a length of about 45 mm, the proximal end of the cigarette 8 does not reach or extend beyond the proximal end of the holder 4.

Figure 5:
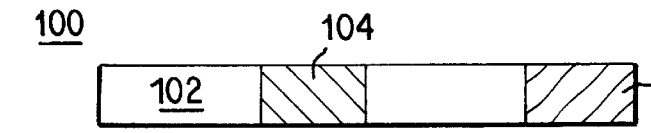
FIG. 5 shows a cigarette used in another embodiment of the present invention.
Figure 6:
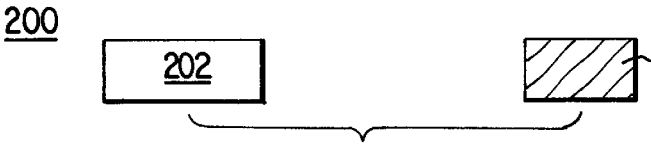
FIG. 6 shows a cigarette combination used in another embodiment of the present invention.

Alternative cigarette constructions are shown in FIGS. 5 and 6. One common feature of the cigarettes shown in FIGS. 4 through 6 is the reduced tobacco column length compared to conventional tobacco column lengths. In each case, the length of the tobacco rod is about 5 mm to 30 mm, e.g., about 17 mm.

The cigarette 100 shown in FIG. 5 has an overall length similar to or the same as many conventional cigarettes (e.g., about 85 mm or 100 mm in length). A "short" tobacco column 106 is formed at one end of the cigarette 100, while a conventional cigarette filter 102 is formed at the other end. These components can be wrapped and joined with conventional tipping, plug and cigarette papers. The space between the filter 102 and the tobacco column 106 can be filled with one or more additional filter elements, such as carbon filtration element 104. One or more gaps can be formed between cigarette components, as is also well known in the art. The advantage of this cigarette 100 is that it outwardly resembles a conventional cigarette and can be alternatively smoked without the use of the smoking accessory 3, like a conventional cigarette.

When the cigarette 100 is inserted in the smoking accessory 3 of FIGS. 1 through 3, its proximal end is substantially flush with the proximal end of holder 4. Alternatively, the lengths of the holder 4 and/or the cigarette 100 can be selected such that the proximal end of the cigarette 100 is shorter than or extends beyond the proximal end of the holder 4. In the latter configuration, the user's mouth makes contact with the filter 102 itself, rather than the holder 4.

FIG. 6 shows yet another combination 200 in which the filter 202 is independent from the tobacco column 204. The tobacco column 204 can be inserted into the smoking accessory 3 at its distal end, while the filter 202 can be inserted into the smoking accessory 3 at its proximal end.

Those skilled in the art will appreciate that additional cigarette design variations are possible. For instance, the diameters of the sleeve and holder can be sized such that the holder can be fit over the sleeve. In this alternative embodiment, stopper elements can be provided which radially project from the inside of the holder which engage the proximal end of the sleeve.

In another alternative embodiment, the sleeve does not project out beyond the distal end of the holder, so that the sleeve overlaps the holder along its entire longitudinal extent. For instance, the sleeve can be implemented as a foil layer which lines the inside of a distal portion of a cardboard tube holder. Still alternatively, an additional layer of foil can be added on the exterior surface of the distal portion of the holder, forming a foil-paper-foil laminate at the distal portion of the holder.

The cardboard-foil embodiments are particularly suitable for smoking articles which are intended to be disposable. In these cases, the filter and tobacco column can be attached to the smoking accessory 3, e.g., with glue. One or more layers of cigarette, plug and/or tipping paper can be eliminated in this case because the cigarette components (the filter and the tobacco column) are not intended to be handled separately from the smoking accessory 3.

Having described the exemplary structure of the smoking article, its preferred functionality and manner of use will now be addressed.

The sleeve 6 restricts the flow of air to the cigarette 8 between puffs, thereby starving the combusting tobacco column 16 of oxygen. Accordingly, the mass burn rate of tobacco is reduced, which, in turn, reduces the amount of sidestream smoke between puffs. At the same time, the perforations 10 in the sleeve 6 and the gap between the sleeve 6 and the cigarette 8 supply enough air to the cigarette 8 between puffs to prevent it from being entirely extinguished. (Alternatively, the smoking article can be designed such that the cigarette 8 will extinguish if the user does not puff on the cigarette 8 in a prescribed amount of time.) For the 17 mm tobacco column discussed above, about 6 to 8 puffs are provided. In contrast, smoking the cigarette 8 without the smoking accessory 3 yields only about 3 puffs.

The gap also ensures that desired levels of heat transfer between the cigarette 8 and the sleeve 6 are maintained. Namely, the gap prevents the sleeve 6 from getting too hot, or from drawing too much energy away from the burning tobacco column 16. Thus, the holder 4 is maintained below a suitable temperature value (e.g., no more than 60° C. at all points along its length) and the tobacco column 16 is prevented from prematurely extinguishing.

The reusable smoking accessory 3 is used by inserting a cigarette 8 into the distal portion of the smoking accessory 3 to produce the smoking article 2, such that the exposed end of the tobacco column 16 is substantially flush with the distal end of the sleeve 6. The cigarette 8 is then lit by exposing the end of the cigarette 8 to a flame from, for instance, a match or lighter. The smoking article 2 is then smoked like a normal cigarette 8 by inserting the proximal end of the holder 4 into the user's mouth and puffing on the smoking article 2. As mentioned above, the sleeve 6 restricts the flow of air to the cigarette 8, thereby reducing the mass burn rate of the cigarette 8. This provides the user with a total of about 6 to 8 puffs from the cigarette 8, as opposed to a total of about 3 puffs when the cigarette 8 is smoked without the smoking accessory 3.

The consumed cigarette 8 can be removed from the smoking accessory 3 by pulling apart the sleeve 6 from the holder 4, and removing the smoked cigarette 8 from the holder 4.

The disposable cigarette (e.g., having a cardboard holder and foil sleeve) is smoked in a similar manner to a conventional cigarette.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims. For instance, although the above-discussion has been framed in the context of cigarettes, the invention extends to any smoking article.

What is claimed is:

1. A smoking accessory for receiving a cigarette, said smoking accessory comprising:

a holder; and a substantially air-impermeable sleeve which is coupled to a distal portion of said holder and is coaxial therewith;

wherein said sleeve includes a wall having at least one opening formed therein;

wherein said holder and sleeve define a longitudinal passageway for receiving the cigarette, such that a gap separates an outer surface of said cigarette from said sleeve; and wherein said sleeve is effective for reducing a flow of air to said cigarette, thereby reducing sidestream smoke generated by said cigarette wherein at least one dilution hole is formed in said holder.

2. The smoking accessory of claim 1, wherein the wall of said sleeve includes a stopping element extending from the inner surface of the wall, and the stopping element engages said distal portion of said holder.

3. The smoking accessory of claim 1, wherein said sleeve comprises a tube which is disposed on an inner surface of said distal portion of said holder.

4. The smoking accessory of claim 1, wherein said holder is made from ceramic material.

5. The smoking accessory of claim 1, wherein said holder is made from a paper-based material.

6. The smoking accessory of claim 1, wherein said sleeve is made from metal.

7. The smoking accessory of claim 6, wherein said sleeve is made from a metal foil.

8. The smoking accessory of claim 1, wherein said sleeve is made from ceramic material.

9. A smoking article, comprising:

a smoking accessory, including:

a holder; and a substantially air-impermeable sleeve which is coupled to a distal portion of said holder and is coaxial therewith;

wherein said sleeve includes a wall having at least one opening formed therein; and a cigarette which is received in said smoking accessory and is coaxial therewith, such that a distal end of said cigarette is disposed at said distal portion of said sleeve, said cigarette including:

a column of tobacco;

wherein said at least one opening is located radially adjacent to said column of tobacco to supply air thereto;

wherein an air gap separates an outer surface of said cigarette from said sleeve;

wherein said sleeve is effective for reducing a flow of air to said cigarette, thereby reducing sidestream smoke generated by said cigarette and wherein at least one dilution hole is formed in said holder.

10. The smoking article of claim 9, wherein said gap is approximately 0.02 to 0.10 mm.

11. The smoking article of claim 9, wherein said column of tobacco is approximately between 5 mm and 30 mm in length.

12. The smoking article of claim 9, wherein said wall of said sleeve includes a stopping element extending from an inner surface of said sleeve, and said stopping element engages said distal end of said holder.

13. The smoking article of claim 9, wherein said holder is made from ceramic material.

14. The smoking article of claim 9, wherein said holder is made from a paperbased material.

15. The smoking article of claim 9, wherein said sleeve is made from metal.

16. The smoking article of claim 15, wherein said sleeve is made from a metal foil.

17. The smoking article of claim 9, wherein said sleeve is made from ceramic material.

18. A smoking article comprising:

a holder;

a substantially air-impermeable sleeve which is coupled to a distal portion of said holder and is coaxial therewith, wherein said sleeve includes a wall having at least one opening formed therein; and a column of tobacco having a length of about 5 mm to 35 mm, wherein said at least one opening is located radially adjacent to said column of tobacco to supply air thereto;

wherein at least one dilution hole is formed in said holder; and wherein a gap separates an outer surface of said tobacco column from said sleeve.

19. A method for using a smoking accessory in smoking a cigarette, the smoking accessory including a holder and a substantially air-impermeable sleeve which is coupled to a distal portion of said holder and is coaxial therewith, wherein at least one dilution hole is formed in said holder, comprising:

inserting the cigarette such that its distal end is disposed at a distal portion of said sleeve, wherein a gap separates an outer surface of said cigarette from said sleeve;

igniting said cigarette within said smoking accessory;

smoking said cigarette within said smoking accessory;

wherein said sleeve is effective for reducing a flow of air to said cigarette, thereby reducing sidestream smoke generated by said cigarette;

removing said sleeve from said holder; and removing said cigarette from said holder and discarding said cigarette.

* * * * *